US007302926B1

(12) United States Patent
Kiker

(10) Patent No.: US 7,302,926 B1
(45) Date of Patent: Dec. 4, 2007

(54) D.C. POWER ENHANCER FOR BATTERY-POWERED VEHICLES AND INTERNAL COMBUSTION ENGINES

(76) Inventor: Harvey George Kiker, 3601 E. Ramsey Way, Avon Park, FL (US) 33825

( * ) Notice: Subject to any disclaimer, the term of this patent is extended or adjusted under 35 U.S.C. 154(b) by 0 days.

(21) Appl. No.: 11/442,084

(22) Filed: May 26, 2006

(51) Int. Cl.
*F02N 17/08* (2006.01)

(52) U.S. Cl. ..... 123/179.25

(58) Field of Classification Search ..... 123/179.25, 123/179.1

See application file for complete search history.

(56) References Cited

U.S. PATENT DOCUMENTS

| | | | | |
|---|---|---|---|---|
| 3,939,814 | A | 2/1976 | Bergstresser | |
| 4,193,651 | A | 3/1980 | Hays | |
| 4,269,160 | A | 5/1981 | Irvin, Jr. | |
| 4,494,520 | A | 1/1985 | Hurwitz | |
| 4,502,025 | A | 2/1985 | Carl, Jr. et al. | |
| 4,596,222 | A | 6/1986 | Ortiz | |
| 4,665,922 | A | 5/1987 | Gillbrand et al. | |
| 4,774,914 | A | 10/1988 | Ward | |
| 4,784,100 | A | 11/1988 | Huan | |
| 4,944,280 | A | 7/1990 | Washington | |
| 5,109,828 | A | 5/1992 | Tagami et al. | |
| 5,134,985 | A | 8/1992 | Rao | |
| 6,084,225 | A * | 7/2000 | Schmitt | 219/672 |
| 6,089,214 | A | 7/2000 | Anderson | |
| 6,328,010 | B1 | 12/2001 | Thurman | |
| 6,358,072 | B1 | 3/2002 | Johnson | |
| 6,374,816 | B1 | 4/2002 | Funk et al. | |
| 6,668,810 | B1 | 12/2003 | St. John et al. | |
| 6,736,119 | B1 | 5/2004 | Kiker | |
| 6,796,298 | B1 | 9/2004 | Kiker | |
| 7,106,047 | B2 * | 9/2006 | Taniguchi | 324/126 |

* cited by examiner

*Primary Examiner*—Stephen K. Cronin
*Assistant Examiner*—Arnold Castro
(74) *Attorney, Agent, or Firm*—Charles J. Prescott

(57) ABSTRACT

In one aspect of this invention, a battery power transfer device connected or connectable to establish an electrical path between a battery and a starter motor of an internal combustion engine. A coil of conductive hollow tubing having a plurality of complete loops is connectable between a positive (+) terminal of the battery and a positive (+) input terminal or contact of the starter motor. In another aspect, a battery power transfer device is connected to connectable to establish an electrical path between a battery and an electric motor of a battery-powered vehicle. The coil of conductive hollow tubing, having a plurality of complete loops, is connectable between a positive (+) terminal of the battery and a positive (+) input of the electric motor. Both aspects of this invention enhance performance.

20 Claims, 2 Drawing Sheets

10
12
14
16
18
20
22
24
26
28
30
32
E
S
G
+
-
BATTERY
D.C.VOLTS

10'
12'
28
14
16
14
30
16
+
M
-
32
+
-
BATTERY
D.C.VOLTS
G

D.C. POWER ENHANCER FOR BATTERY-POWERED VEHICLES AND INTERNAL COMBUSTION ENGINES

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to devices for increasing the power and efficiency of internal combustion engines and for extending the useful service life per charge of battery-powered vehicles, and more particularly to a coil wound tubular conductive device positioned in the pathway between the positive side or terminal of a d.c. battery source and the positive input of the starter motor for internal combustion engines and the drive motor for battery-powered vehicles.

2. Description of Related Art

Virtually all internal combustion engines rely upon a starter motor to initially energize the engine after which the internal combustion process takes over to drive the engine and charging system and electrical system components. These starter motors are typically connected at a positive side or input terminal thereof directly to the positive terminal of a d.c. storage battery with heavy conductive cable to minimize power loss. Likewise, the negative side or ground terminal of the starter motor is typically efficiently grounded to the vehicle or engine to insure optimal electrical power delivery efficiency to the starter motor. Moreover, the entire remainder of the electrical system of an internal combustion engine-powered vehicle taps into the battery power source at the positive terminal of the starter motor.

Battery powered vehicles such as golf carts, personal mobility vehicles and hybrids rely (part time) upon a considerable amount of stored d.c. electrical energy in storage batteries carried by the vehicle for extended drive periods before recharging of the storage batteries is required. Thus, an improvement in service life per charge of these battery powered vehicles of even a small percentage of useful operating time represents significant improvements thereof.

A number of my prior art patents deal with enhancements of the performance of internal combustion engines. Specifically U.S. Pat. Nos. 6,736,119 and 6,796,298. Additionally, a pending application due to issue on May 29, 2006 is directed to an ignition spark enhancing device and spark plug wire disposed in or establishing the electrical path between a spark source and a spark plug of an internal combustion engine. The device includes one or more coils of conductive hollow tubing formed from a length of conductive tubing configured for connection to the spark plug wire of the device or to a spark plug. The tubing is preferably copper and may also be aluminum or other conductive material and is also preferably used to form each spark plug wire as well for durability. At least five complete loops or turns wound concentrically or in helix fashion are preferred. The device is also preferably coated with a non-conductive material to reduce any risk of electrical shock or short circuit.

A number of prior art devices are known which have attempted to provide a "hotter" spark to the spark plugs to achieve the enhanced performance of the engine. One such prior patented device is disclosed in U.S. Pat. No. 4,944,280 invented by Washington which teaches a separated circuit or spark gap producing device that introduces an auxiliary gap into the electrical path between the spark source and the spark plug. This area of technology directed to producing a capacitive-type spark gap for enhanced voltage buildup before current is discharged and reaches the spark plug is well known. However, Washington developed an improved apparatus which accurately controls and varies this spark gap to achieve individual and selective adjustment of the size of the gap to achieve even more optimal performance from the engine.

Tagami in U.S. Pat. No. 5,109,828 teaches an apparatus for supplying high voltage to the spark plug via a spark coil and a distributor plate of unitary construction.

In U.S. Pat. No. 6,328,010, Thurman teaches a spark plug wire harness assembly having a substantially rigid body, plug wire mounting posts, and output terminals. The conductors are embedded within the rigid body.

An electrically controlled engine ignition system for increased power and economy was invented by Huan and disclosed in U.S. Pat. No. 4,784,100. This disclosure is of an ignition system which is capable of controllably adjusting the ignition spark and timing in accordance with conditions imposed on the automobile by road and driver habit.

My two prior U.S. Pat. Nos. 6,736,119 and 6,796,298 teach the use of a hollow coiled conductive tube positioned in each spark wire between the engine distributor and the spark plugs.

The present invention provides a broader inventive aspect for enhancing power efficiency and output of both internal combustion engine-driven vehicles and such engines and to battery-powered vehicles such as golf carts and personal mobility vehicles.

BRIEF SUMMARY OF THE INVENTION

This invention is directed to a battery power transfer device connected or connectable to establish an electrical path between a battery and a starter motor of an internal combustion engine. A coil of conductive hollow tubing having a plurality of complete loops is connectable between a positive (+) terminal of the battery and a positive (+) input terminal or contact of the starter motor. In another aspect, a battery power transfer device is connected to connectable to establish an electrical path between a battery and an electric motor of a battery-powered vehicle. The coil of conductive hollow tubing, having a plurality of complete loops, is connectable between a positive (+) terminal of the battery and a positive (+) input of the electric motor. Both aspects of this invention enhance performance.

It is a broad object of this invention to provide a power-enhancing device for vehicles utilizing a d.c. battery storage.

Yet another object of this invention is to provide a power enhancing device connectable between a d.c. battery and the starter of an internal combustion engine.

Still another object of this invention is to provide a power-enhancing device for battery-powered vehicles such as golf carts, personal mobility vehicles and hybrids (part of the time) which extends the service life per charge of such vehicles.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

My earlier teachings in U.S. Pat. Nos. 6,736,119 and 6,796,298 and pending application Ser. No. 10/832,021 filed Apr. 26, 2004 and issuing May 29, 2006 are incorporated herein by reference.

Figure 1:
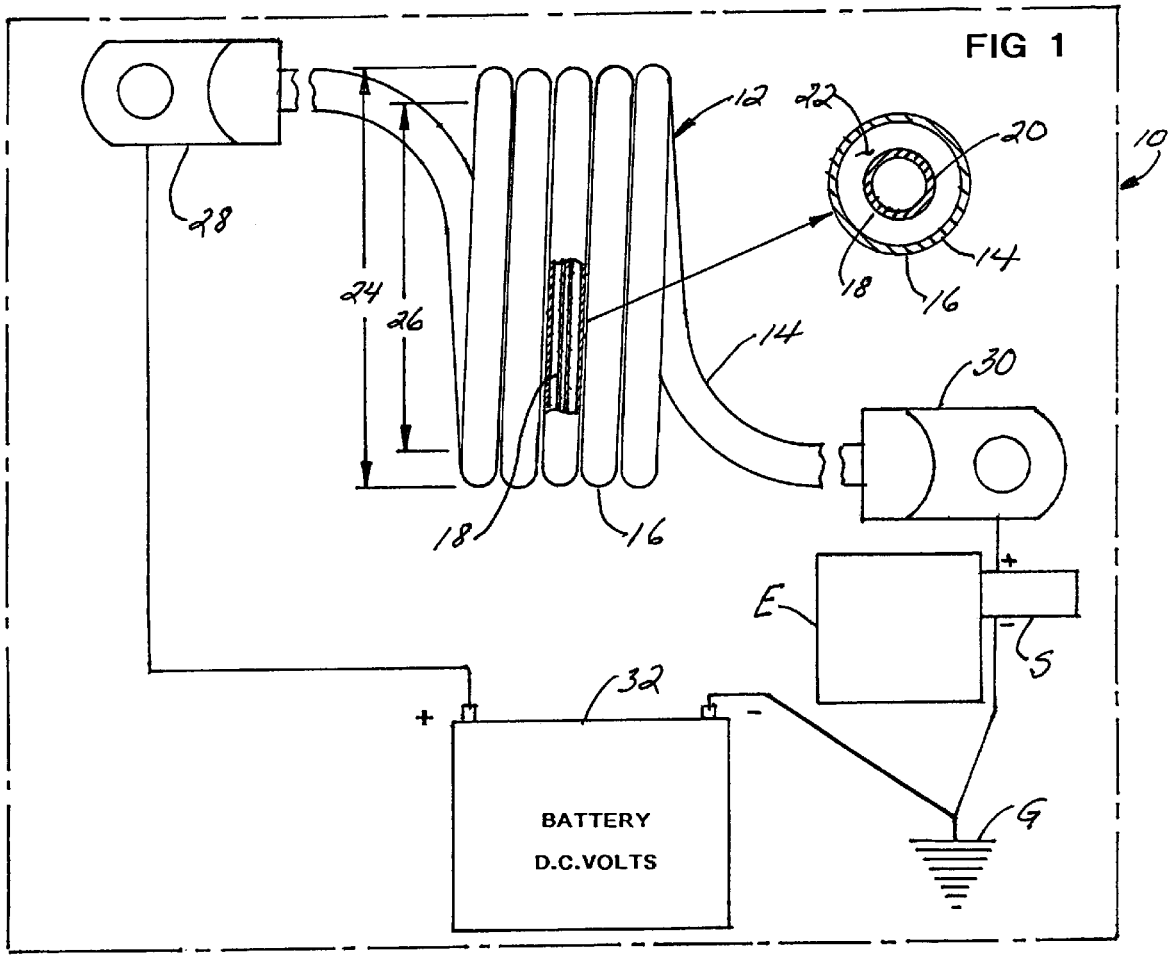
FIG. 1 is a simplified schematic view of one embodiment and aspect of the invention.

Referring now to the drawings, and firstly to FIG. 1, one system or aspect of the invention is there shown generally at numeral 10 in the form of a vehicle or system dependent upon and powered by an internal combustion engine E having a starter motor S. The internal combustion engine E, whether gas or diesel operated, requires a starter motor S which is typically operably connected to the output terminals of a d.c. storage battery shown generally at numeral 32. Absent the invention which is shown at 12, the positive terminal of a starter motor S is connected directly to the positive output terminal of the storage battery 32 while the ground G or negative (−) side of the starter motor S is connected to ground G and to the negative or ground side of the storage battery 32.

The power enhancement is accomplished through a battery power transfer device 12 which is formed of an elongated length of copper tubing 14 which, in its main midportion, is coiled in uniform closely spaced together coils 16 about a mandrel or imaginary cylinder having a diameter 26, preferably approximately 2.5" in diameter (I.D.). Five (5) complete coils 16 are preferred as shown. The copper tubing 14 has an outside diameter of ¼", an inside diameter of 3/16" and a wall thickness of 1/32". Thus, the outside diameter (O.D.) 24 is preferably 3".

One end 28 of the device 12 is electrically connected to the positive (+) terminal of the battery 32 while the other end 30 of the device 12 is electrically connected to the positive (+) or input terminal of the starter motor S which is grounded at G along with the negative (−) terminal of the battery 32.

In the preferred embodiment 12 of this aspect of the invention associated with an internal combustion engine E having a starter S, a length of inner tubing 18 is also provided which is generally coextensive with the length of tubing 14. The sizing of this length of inner tubing 18, which includes coils 20, again coextensive with the coils 16 of the length of tubing 14, is sized so as to be insulated at 22 from the outer tubular tubing 14. The preferred sizing for this inner tubing 18 has an outside diameter (O.D.) of ⅛", an inside diameter (I.D.) of 1/16" and a wall thickness of 1/32".

Figure 2:
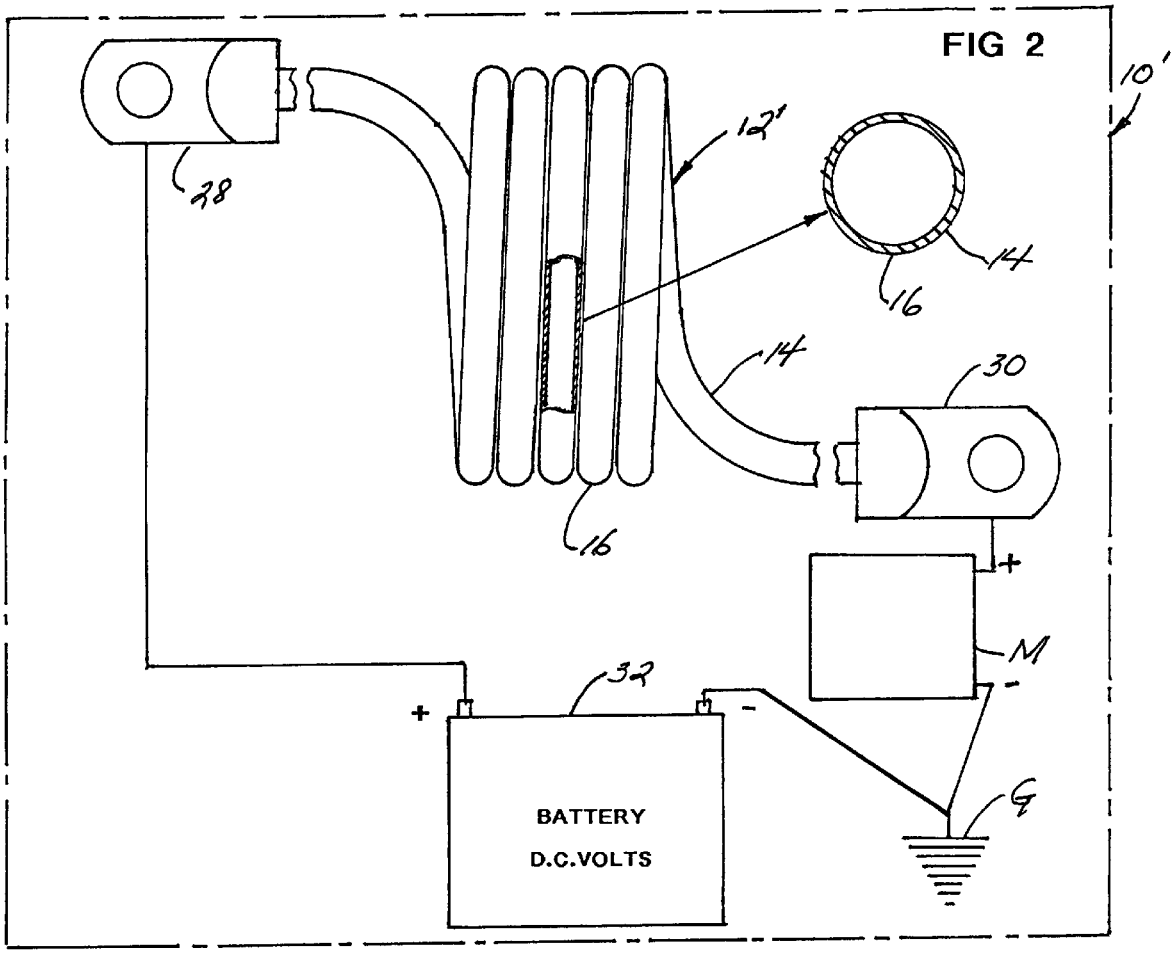
FIG. 2 is a simplified schematic view of another embodiment and aspect of the invention.

Turning now to FIG. 2, another aspect of the invention is shown generally at numeral 10' in the form of a battery-powered vehicle such as a golf cart, a personal mobility vehicle or a hybrid vehicle which alternately utilizes both an internal combustion engine and a battery-driven motor for propulsion. In such a vehicle or system 10', a d.c. voltage storage battery 32 has its positive terminal electrically connected to one end 28 of the device 12' while the other end 30 of the device 12' is electrically connected to the positive (+) input terminal of a d.c. motor M, the negative (−) terminal thereof being grounded at G. Likewise, the negative (−) terminal of the storage battery 32 is also grounded at G.

In this embodiment of the device 12', only the exterior tubing 14 is utilized and includes a total of five complete coils 16 formed in the length of the copper tubing 14 as previously described.

The primary benefit of this aspect of the invention is both increased vehicle top speed and increased duration of useful battery charge before recharging of the battery 32 is required.

It should be understood that the devices 12 and 12' may be formed of various tubing sizes and coil sizes such that the tubing 14 may be in the range of ⅛" to ½" outside diameter (O.D.) and having a wall thickness of in the range of 1/32" to ⅛". Although a plurality of coils are required, five (5) such coils 16 are preferred. Each of these devices 12 and 12' is also preferably coated with a non-conductive material (not shown) so as to reduce any risk of electrical shock or shorting of the otherwise conductive tubing 14.

Scope of Applications

This invention is useful with respect to cars, trucks, boats, lawn mowers, golf carts, gas or diesel engines having an electric starter motor, aircraft, and battery-to-battery interconnections and the like. This invention enhances the power delivery into such systems generally and more particularly to the starter motor of internal combustion engines and into the drive motor of battery-powered vehicles. Some test examples utilizing the present invention in its various forms are described herebelow.

EXAMPLE 1

A 2005 Saturn 4-cylinder vehicle which included the multi-coil spark enhancing device as disclosed in the above-referenced '298 patent, demonstrated substantially increased mileage and power after the present invention was installed between the positive terminal of a d.c. battery and the positive input terminal of the starter motor. Fuel economy increased approximately 2 to 3 mpg.

EXAMPLE 2

A large 3" O.D. version of the present invention having the overall dimensions and sizing as above described in the figures, was operably attached to a 1998 Vermerr Model 1250A wood chipper. This apparatus is powered by a 150 hp Perkins turbo diesel engine. Prior to installation of this invention, the Perkins engine consumed approximately 4+ gallons per hour. After the invention was connected between the battery and the starter, the fuel consumption dropped down to 2 to 3 gallons per hour representing a fuel efficiency factor of between 25% and 50%. This installation demonstrated increased power and torque capabilities, appears to be substantially quieter and smoother during operation, and accelerated to operating rpm from an idle faster.

EXAMPLE 3

A 1986 International truck powered by a 9.0 liter V8 diesel engine prior to the installation of the present invention averaged approximately 6.4 mpg. After installation of the invention as shown in FIG. 1 absent the inner tubing, the mileage increased to an average of 7.7 mpg. At 1500 rpm idle speed, prior to installation of the device, the diesel engine consumed 1.5 gph. After installation of the device, for a period of approximately two hours of run time including idle and twelve miles of driving, the total fuel consumption was 2.0 gallons of diesel fuel, or 1.0 gph.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A battery power transfer device connected or connectable to establish an electrical path between a battery and a starter motor of an internal combustion engine, comprising:

a coil of conductive hollow tubing having a plurality of complete loops, a first end thereof configured for connection to a positive (+) terminal of the battery and a second end of said coil configured to connection to a positive input of the starter motor;

said coil carrying electric power between the battery and the starter motor for enhanced electric power delivery to the starter motor.

2. A battery power transfer device as set forth in claim 1, wherein:

said coil has five (5) complete loops.

3. A battery power transfer device as set forth in claim 1, wherein:

said coil has an inside diameter (I.D.) of at least about 3/16" and an outside diameter (O.D.) of up to about ½" and a wall thickness of about at least 1/32".

4. A battery power transfer device as set forth in claim 1, wherein:

each said loop has an inside diameter (I.D.) of at least about 1" and an outside diameter (O.D.) of up to about 5".

5. A battery power transfer device as set forth in claim 1, further comprising:

an inner coil of conductive hollow tubing positioned within and being substantially co-extensive with said coil;

said inner coil sized in outside diameter (O.D.) to be spaced from substantial contact with the inside surface of said coil.

6. In a system powered by an internal combustion engine having a starter motor, the system also including a battery for starting the engine, the improvement comprising:

a length of hollow conductive tubing having a plurality of complete loops formed therein, a first end of said tubing connected to a positive terminal of the battery, a second end of said tubing connected to a positive (+) input of said starter motor;

said tubing carrying electric power between the battery and the starter motor for enhanced electric power delivery to the starter motor.

7. A battery power transfer device as set forth in claim 6, wherein:

said conductive tubing has five (5) complete loops.

8. A battery power transfer device as set forth in claim 6, wherein:

said conductive tubing has an inside diameter (I.D.) of at least about 3/16" and an outside diameter (O.D.) of up to about ½" and a wall thickness of about at least 1/32".

9. A battery power transfer device as set forth in claim 6, wherein:

each said loop has an inside diameter (I.D.) of at least about 1" and an outside diameter (O.D.) of up to about 5".

10. A battery power transfer device as set forth in claim 6, further comprising:

a length of hollow conductive inner tubing positioned within and being substantially co-extensive with said conductive tubing;

said inner tubing sized in outside diameter (O.D.) to be substantially separated from contact with the inside surface of said conductive tubing.

11. A battery power transfer device connected or connectable to establish an electrical path between a battery and an electric motor of a battery-powered vehicle, comprising:

a coil of conductive hollow tubing having a plurality of complete loops, a first end thereof configured for connection to a positive (+) terminal of the battery and a second end of said coil configured to connection to a positive input of the electric motor;

said coil carrying electric power between the battery and the starter motor for enhanced electric power delivery to the starter motor.

12. A battery power transfer device as set forth in claim 11, wherein:

said coil has five (5) complete loops.

13. A battery power transfer device as set forth in claim 11, wherein:

said coil has an inside diameter (I.D.) of at least about 3/16" and an outside diameter (O.D.) of up to about ½" and a wall thickness of about at least 1/32".

14. A battery power transfer device as set forth in claim 11, wherein:

each said loop has an inside diameter (I.D.) of at least about 1" and an outside diameter (O.D.) of up to about 5".

15. A battery power transfer device as set forth in claim 11, further comprising:

an inner coil of conductive hollow tubing positioned within and being substantially co-extensive with said coil;

said inner coil sized in outside diameter (O.D.) to be spaced from substantial contact with the inside surface of said coil.

16. In a vehicle driven by an electric motor or electric device, the vehicle including a battery for powering the electric motor or electric device, the improvement comprising:

a length of hollow conductive tubing having a plurality of complete loops formed therein, a first end of said tubing connected to a positive terminal of the battery, a second end of said tubing connected to a positive (+) input of said electric motor or electric device;

said tubing carrying electric current to the electric motor from the battery for enhanced power delivery.

17. A battery power transfer device as set forth in claim 16, wherein:

said conductive tubing has five (5) complete loops.

18. A battery power transfer device as set forth in claim 16, wherein:

said conductive tubing has an inside diameter (I.D.) of at least about 3/16" and an outside diameter (O.D.) of up to about ½" and a wall thickness of about at least 1/32".

19. A battery power transfer device as set forth in claim 16, wherein:

each said loop has an inside diameter (I.D.) of at least about 1" and an outside diameter (O.D.) of up to about 5".

20. A battery power transfer device as set forth in claim 16, further comprising:

a length of hollow conductive inner tubing positioned within and being substantially co-extensive with said conductive tubing;

said inner tubing sized in outside diameter (O.D.) to be substantially separated from contact with the inside surface of said conductive tubing.

* * * * *